US006415846B1

(12) United States Patent
O'Hara

(10) Patent No.: US 6,415,846 B1
(45) Date of Patent: Jul. 9, 2002

(54) TURBOCHARGERS

(75) Inventor: Stephen John O'Hara, Huddersfield (GB)

(73) Assignee: BorgWarner Inc., Troy, MI (US)

( * ) Notice: Subject to any disclaimer, the term of this patent is extended or adjusted under 35 U.S.C. 154(b) by 0 days.

(21) Appl. No.: 09/458,963

(22) Filed: Dec. 10, 1999

Related U.S. Application Data

(63) Continuation of application No. 09/305,674, filed on May 5, 1999, now abandoned, which is a continuation of application No. 08/704,608, filed on Sep. 17, 1996, now abandoned, which is a continuation of application No. PCT/GB95/00594, filed on Mar. 17, 1995.

(30) Foreign Application Priority Data

Mar. 19, 1994 (GB) ..... 9405440

(51) Int. Cl.[7] ..... B22D 33/04
(52) U.S. Cl. ..... 164/47; 164/246; 164/137
(58) Field of Search ..... 164/47, 246, 137

(56) References Cited

U.S. PATENT DOCUMENTS 3,969,804 A 7/1976 MacInnes et al.
4,613,288 A * 9/1986 McInerney ..... 417/407
5,143,143 A * 9/1992 Tausk ..... 164/246
5,277,241 A 1/1994 Schneider ..... 164/246 X

FOREIGN PATENT DOCUMENTS

| | | | |
|---|---|---|---|
| CH | 225596 | 5/1943 | |
| EP | 0 240 091 | 10/1987 | |
| GB | 809025 | 2/1959 | |
| JP | 63-126657 | 5/1988 | ..... 164/47 |
| JP | 4-9245 | 1/1992 | ..... 164/47 |

* cited by examiner

*Primary Examiner*—Nam Nguyen
*Assistant Examiner*—I.-H. Lin
(74) *Attorney, Agent, or Firm*—Pendorf & Cutliff; Greg Dziegielewski

(57) ABSTRACT

A method of manufacturing a turbocharger including a housing with a compressor housing portion, turbine housing portion, and a connecting portion is such that an appropriate attitude setting for various portions is preselected, and the housing is then manufactured using a casting technique. The geometry of the connecting portion is circular and concentric with respect to a common center line passing through all three portions.

3 Claims, 4 Drawing Sheets

TURBOCHARGERS

This application is a continuation application filed under 37 CFR § 1.53(b) of patent application Ser. No. 09/305,674, filed May 5, 1999, now abandoned which in turn is a continuation of patent application Ser. No. 08/704,608, filed Sep. 17, 1996, now abandoned, which is a continuation of PCT/GB95/00594, filed Mar. 17, 1995.

BACKGROUND OF THE INVENTION

1. Field of the Invention

The invention relates to turbochargers, and is particularly concerned with problems associated with what is known as attitude setting of turbochargers.

2. Description of the Related Art

A turbocharger basically comprises a compressor and a turbine coupled together, generally with a common shaft. Engine exhaust gases are fed into the turbine and rotate the turbine and the common shaft. This drives the compressor, which is used to force air into the engine.

The compressor has an inlet and an outlet, as does the turbine. On any given engine, there may be an optimum position for the location of the compressor inlet and/or outlet and an optimum position for the location of the turbine inlet and/or outlet. The compressor position may not necessarily have the same attitude with respect to the turbine position on different engines.

It has therefore been necessary to provide means for clamping the compressor housing to the turbine housing in different positions so that the attitude of the compressor housing with respect to the turbine housing can be adjusted to suit any given engine.

This not only necessitates the use of complicated clamping rings and associated seals, but a very sophisticated jig is necessary to hold and adjust the housings prior to clamping them together.

A further problem associated with known turbochargers is that extensive milling and drilling is required to manufacture the housings.

SUMMARY OF THE INVENTION

We have now developed a method of turbocharger manufacture, which eliminates or substantially reduces the above-mentioned problems.

According to the invention, a method of manufacturing a turbocharger comprises designing a turbocharger housing having a compressor housing portion, a turbine housing portion, and a connecting portion, the geometry of at least the connecting portion being circular and concentric with respect to a common centerline passing through all three positions, and then manufacturing the housing using a casting technique, the attitude of the compressor portion with respect to the turbine portion being preselected prior to casting by appropriate adjustment of the mould utilized in the casting process.

There may, for example, be a compressor housing mould portion and a turbine housing mould portion, the two mould portions being rotatable with respect to one another about the said centerline before casting takes place.

It is preferred that each inlet and outlet to the housing is circular, with an annular groove, so that connections to other components can be made using annular seals and clamping rings, such as those known as MARMAN fittings.

Preferably the dimensions of each inlet and outlet are made substantially identical, so that a single size of clamping fitting can be used for connection to other components.

The invention includes a turbocharger having a housing manufactured by the method according to the invention.

There may be a series of different turbochargers having different attitude settings.

The invention includes casting apparatus for use in carrying out the method according to the invention.

The apparatus preferably has a compressor housing mould portion and a turbine housing mould portion, the two mould portions being rotatable with respect to one another.

BRIEF DESCRIPTION OF THE DRAWINGS

By way of example, specific embodiment of the invention will now be described, with reference to the accompanying drawings, in which.

DETAILED DESCRIPTION OF THE INVENTION

Figure 2:
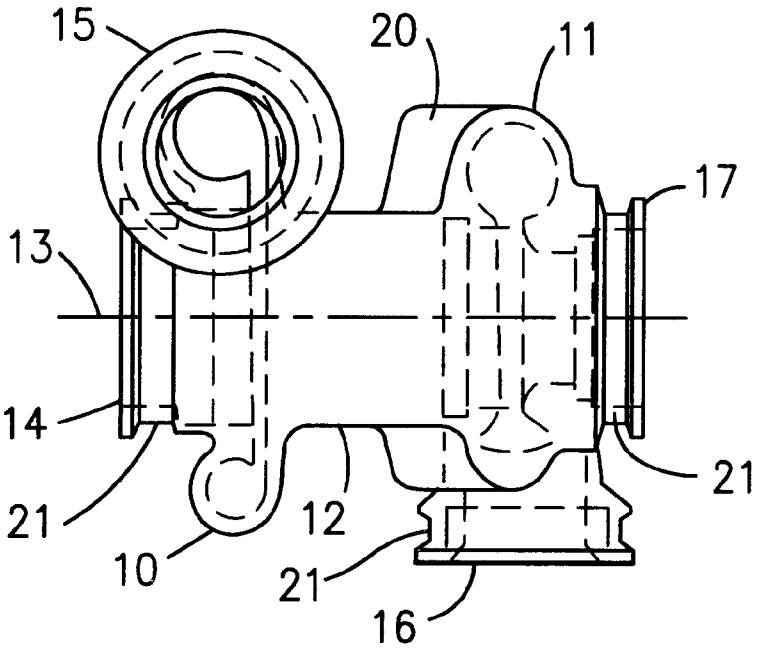
FIG. 2 is a view looking in the direction of arrow II of FIG. 1.
Figure 1:
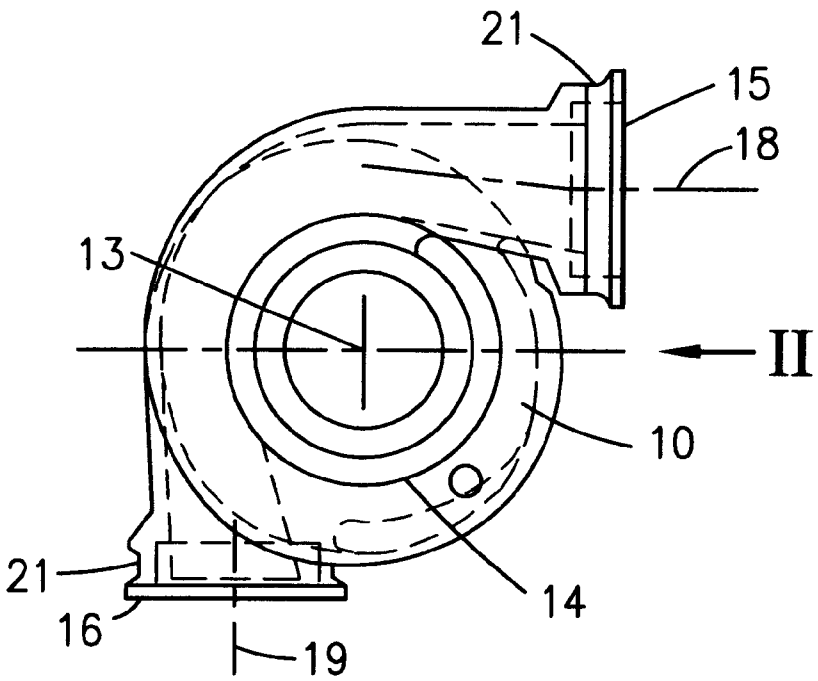
FIG. 1 is a view of a first embodiment of turbocharger housing manufactured according to the invention, looking along the centerline of the housing.

Referring firstly to FIGS. 1 and 2, there is shown a turbocharger housing comprising a compressor portion 10 and a turbine portion 11. A common centerline 13 extends through the housing.

The compressor portion has an inlet 14 and an outlet 15. The turbine has an inlet 16 and an outlet 17.

The housing is manufactured from ductile iron using a casting process. It can be seen from FIG. 1 that the axis 18 of the compressor outlet 15 is at 90° with respect to the axis 19 of the turbine inlet.

Different engines may require different attitudes of the axis 18 with respect to the axis 19. The invention makes it possible to pre-select attitude setting before manufacture. Because the geometry of the connecting portion 12 of the housing is circular and concentric with respect to the axis 13, portions of the mould used in the casting process can be adjusted with respect to each other about the axis 13 to bring about any desired attitude setting.

Figure 4:
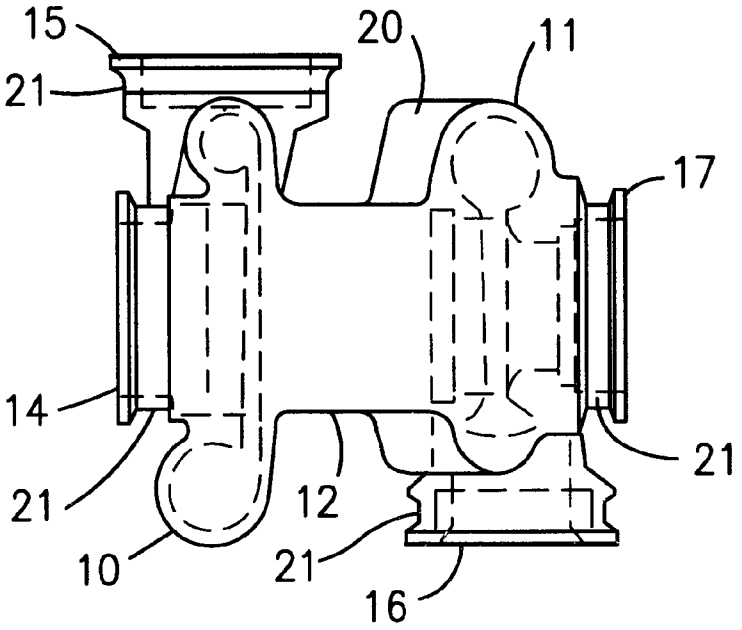
FIG. 4 is a view looking in the direction of arrow IV of FIG. 3.
Figure 3:
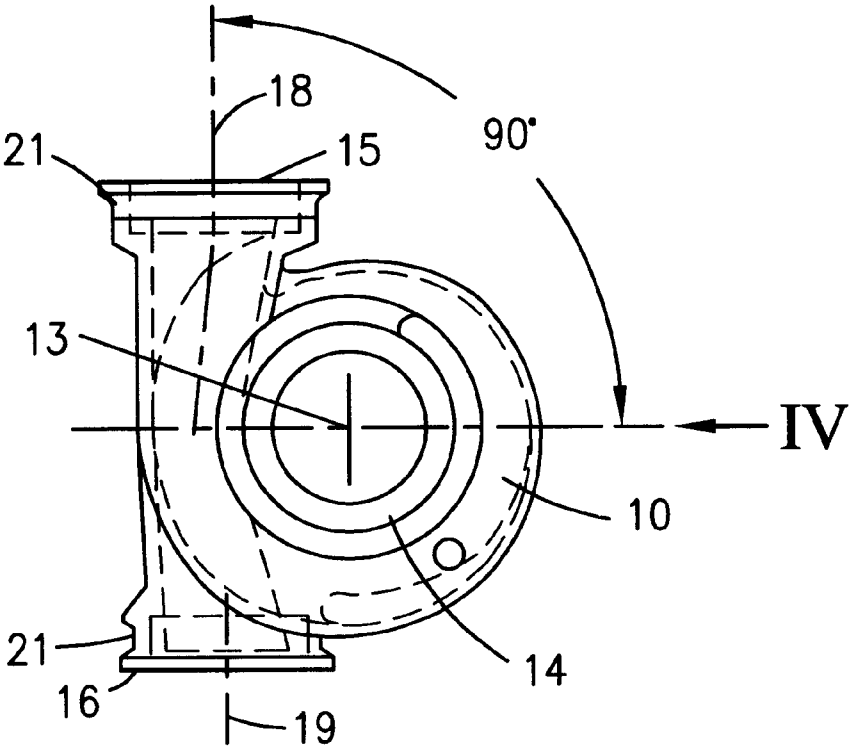
FIG. 3 is a view similar to FIG. 1, but showing a second embodiment of turbocharger housing according to the invention.

In FIGS. 3 and 4, for example, a second embodiment of housing is shown, which is substantially identical to that shown in FIGS. 1 and 2, similar reference numerals being used throughout. However, it will be seen that the compressor outlet axis 18 now extends in the same direction as the turbine inlet attitude 19, instead of being at 90° to one another. Any attitude setting whatsoever can be selected.

Because attitude setting is pre-selected during manufacture, no complicated attitude setting is necessary after manufacture, and no special components are needed to clamp housing parts together. Customers received exactly the attitude setting that they have requested, and the desired attitude cannot subsequently get out of alignment.

Figure 5:
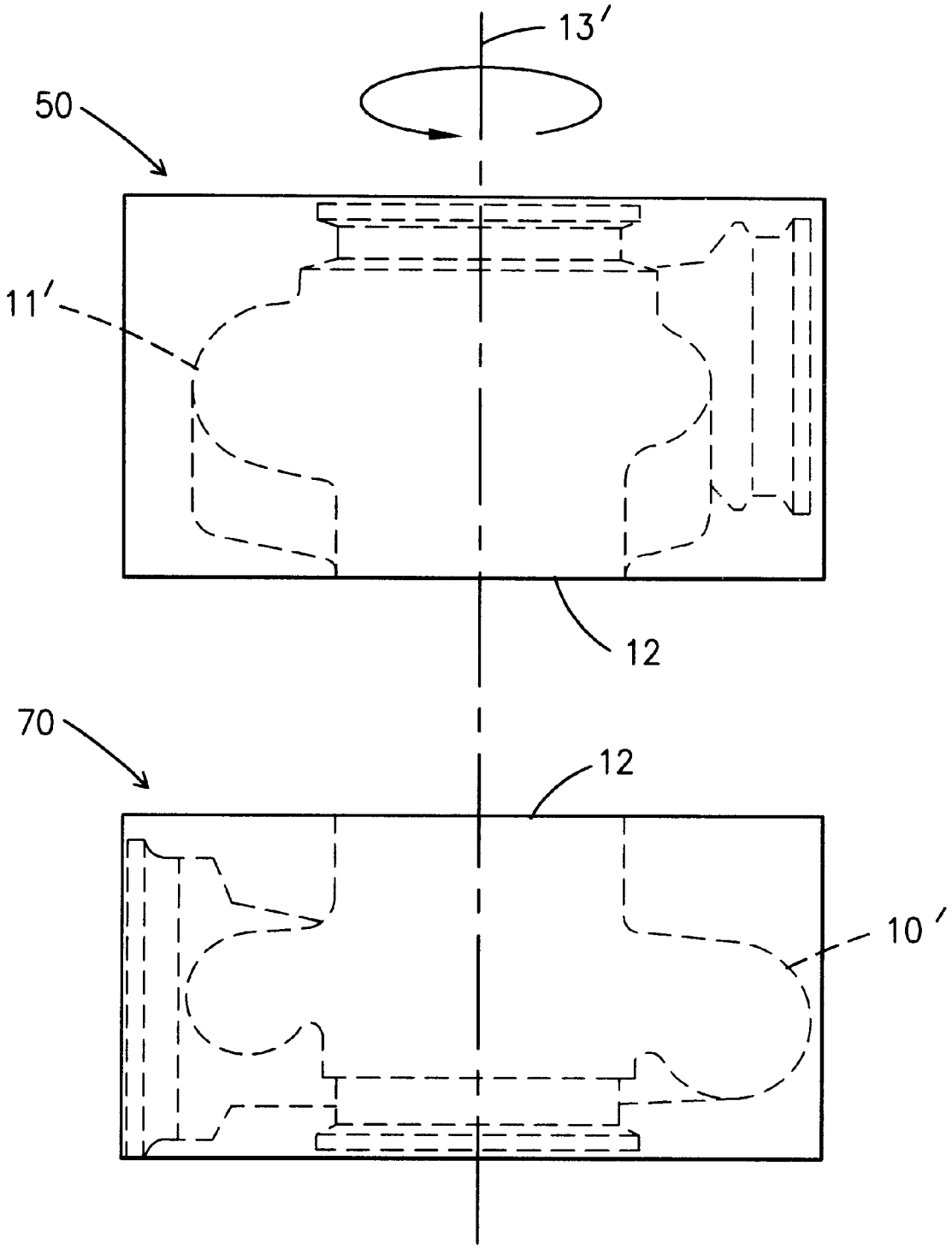
FIG. 5 is a side view showing separate turbine and compressor mold portions used in casting a turbocharger housing according to the method of the present invention.

Referring to FIG. 5, representative turbine, connector, and compressor mold portions 50 and 70, respectively, are depicted. The mold portions are shown aligned with common centerline 13' in preparation for assembly.

The interior of turbine mold portion 50 is formed as is known in the art to create a turbine portion 11' shown in ghost outline.

Compressor mold portion 70 includes an interior formed, again as is known in the art, to create a compressor portion 10' also shown in ghost outline.

Figure 6:
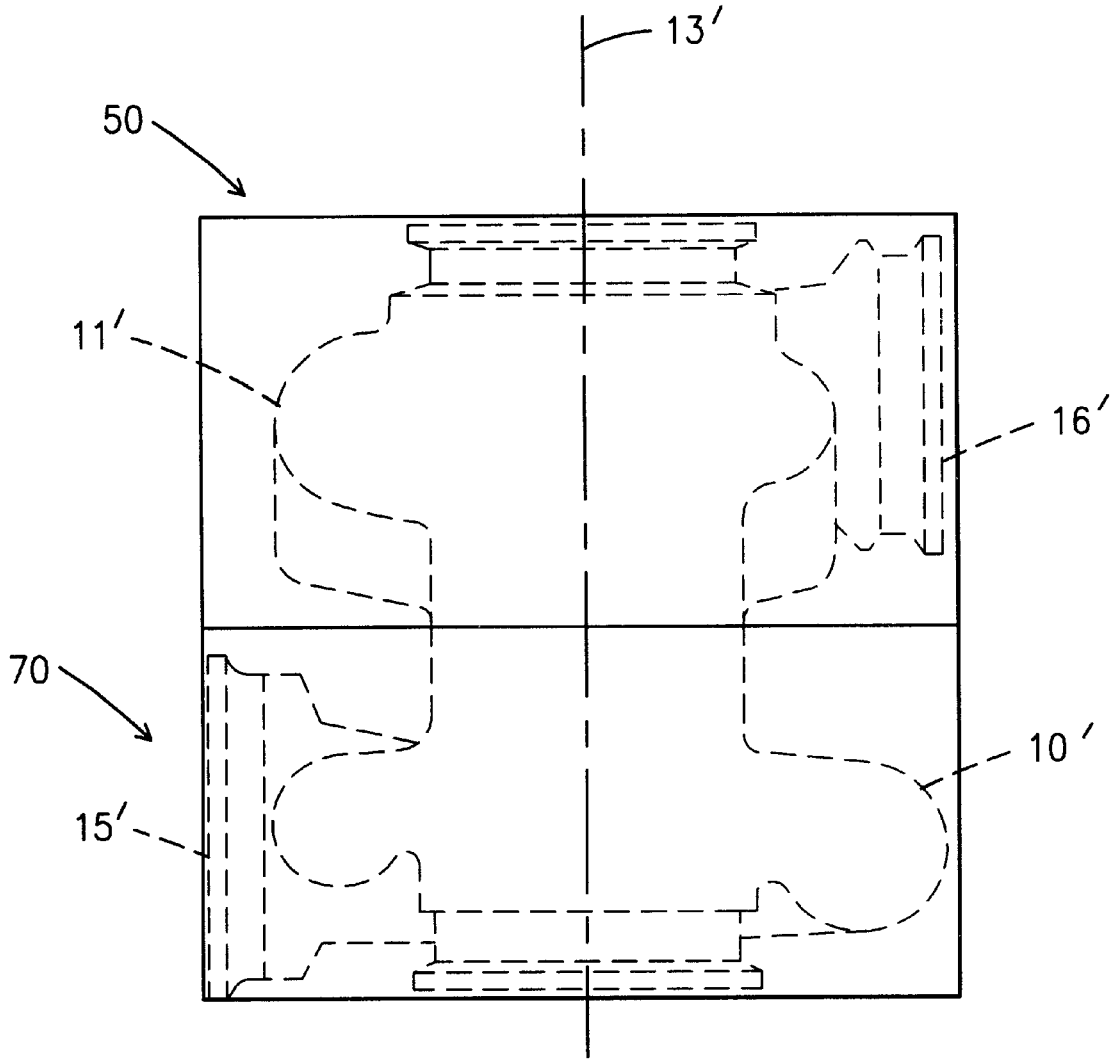
FIG. 6 is a side view of the mold portions of FIG. 5 combined to cast a turbocharger housing according to the method of the present invention.

In FIG. 6, mold portions 50 and 70 are shown combined in preparation for casting the turbocharger housing. Mold portions 50 and 70 are shown in a stacked arrangement along common centerline 13'. The mold portions are connected, and the housing is cast using techniques well known in the art. In FIG. 6, inlet 16' of turbine portion 50 and outlet 15' of compressor portion 70 are oriented 180 degrees apart to produce the housing of FIGS. 3 and 4 wherein turbine inlet air flow and compressor outlet air flow are in the same directions. The invention contemplates rotation of the turbine mold portion 50, relative to the compressor mold portion 70 to achieve whatever attitude is prescribed in the design of the particular turbocharger housing being cast. This feature is made possible by the cylindrical geometry of the connecting body portion of the turbocharger housing.

Manufacture of the housing takes place in a single process, and no milling or drilling is required.

Turbocharger assembly time is substantially reduced.

Because the housing is a single component, there is a risk of undesirable heat conduction from the turbine to the compressor, but this can be minimized by casting into the housing webs or fins such as those shown at 20 in FIGS. 2 and 4. Alternatively, air or water jackets may be provided, for example, cast as an integral part of the turbine section, or the center section, or both.

A further advantage of the embodiments of housing shown in the drawings is that we have eliminated not only milling and drilling, but also the need for tapping. Conventional housings are generally connected at inlets and outlets by flanges, which are bolted together. This necessitates drilling and tapping of bolt holes.

In the embodiments shown, each inlet or outlet is circular, and has an annular groove 21. This makes it possible to make a connection to a similar-shaped component by using a clamping ring, and appropriate seals, the clamping ring, for example, having a U-shaped or V-shaped groove in its inner periphery, so that one wall of the clamping ring will seat in one of the grooves 21, and the other wall of the clamping ring will seat in a similar groove of the component to which the housing is connected. Fittings known as MARMAN fittings may, for example, be used.

Yet another advantage is that each of the inlets and outlets, and associated annular grooves 21, are of the same size, so that only one size of clamping ring needs to be stocked to make all the necessary connections to the housing.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

This invention is not restricted to the details of the foregoing embodiment (s). The invention extends to any novel one, or any novel combination, of the features disclosed in this specification (including any accompanying claims, abstract, and drawings), or to any novel one, or any novel combination, of the steps of any method or process so disclosed.

Now that the invention has been described.

What is claimed is:

1. A method of manufacturing an integrated turbocharger housing comprising a compressor housing portion, turbine housing portion and connecting portion, using an attitude-setting-adjustable casting mold, said method comprising the steps of:

(a) determining a specific attitude to which the compressor housing portion is to be set with respect to the turbine housing portion of the turbocharger housing;

(b) configuring a compressor mold portion for the compressor housing portion relative to a turbine mold portion for the turbine housing portion to the attitude determined in step (a), said mold portions having a connecting geometry which is circular and concentric for making a combined mold portions, said combined mold portions freely rotatable relative to each other about a common axis, said mold portions freely adjustable with respect to attitude setting; and (c) casting the turbocharger housing as a single integral housing using the combined mold portions.

2. A method as recited in claim 1, wherein said configuring step includes the step of rotating the compressor mold portion and the turbine mold portion relative to each other about the centerline.

3. A method as recited in claim 1, wherein said configuring step includes configuring the mold portions of said turbocharger housing to include fins, said fins for conducting heat from said turbocharger housing.

* * * * *